US005628654A

United States Patent [19]

Lineberry, Jr.

[11] Patent Number: 5,628,654

[45] Date of Patent: May 13, 1997

[54] VEHICLE ACCESSORY CONNECTOR

[76] Inventor: Dewey R. Lineberry, Jr., 3214 Alder Way, Greensboro, N.C. 27407-6748

[21] Appl. No.: 489,442

[22] Filed: Jun. 12, 1995

[51] Int. Cl.[6] ..... H01R 13/68

[52] U.S. Cl. ..... 439/622; 439/651

[58] Field of Search ..... 439/622, 621, 439/651; 337/264

[56] References Cited

U.S. PATENT DOCUMENTS

| | | | |
|---|---|---|---|
| 4,221,455 | 9/1980 | Cairns et al. | 339/186 M |
| 4,846,733 | 7/1989 | Baisz et al. | 439/622 |
| 4,884,050 | 11/1989 | Kozel | 337/264 |
| 4,986,767 | 1/1991 | Kozel | 439/621 |
| 5,154,640 | 10/1992 | Chen | 439/621 |
| 5,324,214 | 6/1994 | De Castro | 439/621 |
| 5,346,411 | 9/1994 | Nikkinen | 439/621 |

*Primary Examiner*—Gary F. Paumen
*Assistant Examiner*—Christopher Goins

[57] ABSTRACT

An accessory connector is provided for insertion into a vehicle fusebox which includes a receptacle for communication with conventional fuses. The connector can be quickly installed by a technician or vehicle owner without modifying the fusebox or fuses. The accessory connector utilizes the safety features of the fuse as will be connected thereto, while conveniently allowing the vehicle owner to add a stereo, radio or other accessory to the electrical system of the vehicle immediately without rewiring the circuits.

11 Claims, 2 Drawing Sheets

10
13
14
14'
17
20

17
20
19
11

10
17
13
11

4
4
18
11

16
15'
A
2
2
17
11'
12
15
A
13
11
23
10

PRIOR ART

VEHICLE ACCESSORY CONNECTOR

BACKGROUND OF THE INVENTION

1. Field of the Invention

The invention herein pertains to electrical connectors for vehicles and particularly pertains to vehicle connectors which are attached to the fusebox.

2. Background and Objectives of the Invention

In recent years more and more electrical and electronic accessories for automobiles, trucks, boats, planes and other vehicles have been manufactured such as CD (compact disc) players, radios, computers, telephones, facsimile machines and other devices which operate on low voltages. Few if any extra electrical connections are provided by vehicle manufacturers (with necessary wiring) to accommodate such accessories. Therefore, the vehicle owner is faced with a dilemma when he purchases an accessory, as he may spend needless dollars for new electrical circuitry to add the desired accessory. Also, if the vehicle is not properly wired, circuits can overload causing damage and sometimes fires which can injure the vehicle and its occupants as a result.

Thus, with the need for adequate wiring for vehicle accessories being understood, the present invention was conceived and one of its objectives is to provide an accessory connector for the electrical circuitry of vehicles to permit suitable connections therewith.

It is another objective of the invention herein to provide an accessory connector which utilizes fuses as are presently available to maintain the designed safety features.

It is also an objective of the invention to provide an accessory connector which can be installed by those relatively unskilled in electrical wiring.

It is still another objective of the invention to provide an accessory connector which will receive conventional vehicle fuse blades.

Another objective of the invention is to provide an accessory connector which is inexpensive to manufacture and which is easily adaptable to accommodate a wide range and types of vehicle accessories.

Various other objectives and advantages of the present invention will become apparent to those skilled in the art as a more detailed description is presented below.

SUMMARY OF THE INVENTION

An accessory connector is provided which includes a plastic, non-conducting housing containing a pair of connector blades for inserting in a typical vehicle fusebox by first removing therefrom, a particular fuse. The accessory connector includes a conductor wire extending from its housing which can supply power to a typical accessory such as a CD player, stereo, or the like. The accessory connector defines a pair of fuse blade receptacles for inserting fuse blades therein, after removing the fuse from the fusebox so that the accessory connector is then electrically joined or sandwiched between the fuse and the fusebox. In this configuration, the accessory connector maintains the integrity of the original safety features of the vehicle circuitry. Since the installation of the accessory connector is very simple, it does not usually require a skilled technician for installation of the selected accessory.

DETAILED DESCRIPTION OF THE PREFERRED EMBODIMENT AND OPERATION OF THE INVENTION

Figures 1, 1A, 2, 3, 4:
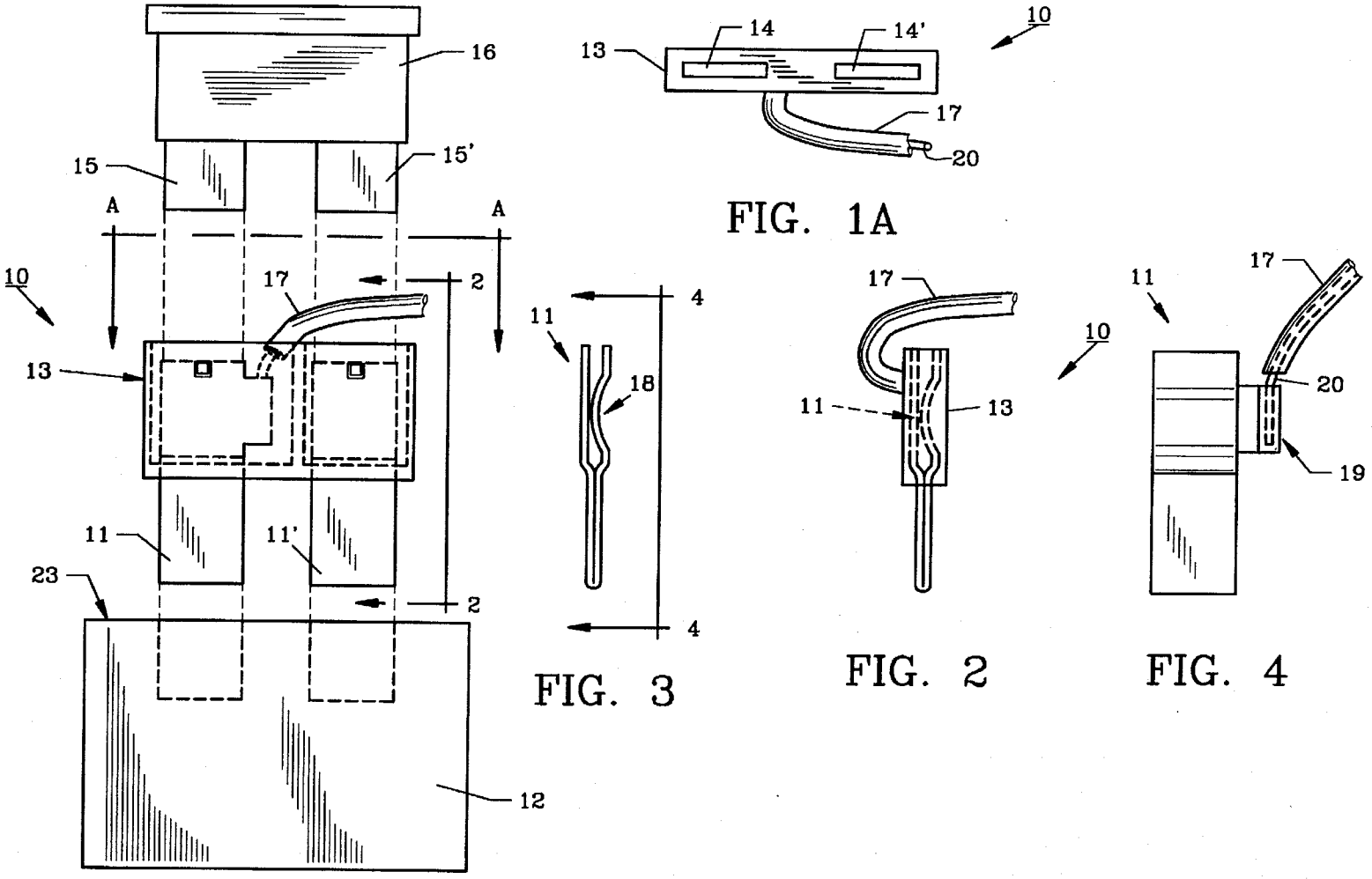
FIG. 1 illustrates an exploded view of the preferred form of the invention herein as used with a typical vehicle fusebox and fuse.
FIG. 1A shows a top view of the accessory connector as seen in FIG. 1 along lines A—A.
FIG. 2 demonstrates a side view of the accessory connector as shown in FIG. 1.
FIG. 3 provides a side view of the connector blade as shown in FIG. 2 as removed from the housing.
FIG. 4 depicts a frontal view of the connector blade as seen in FIG. 3 with the conductor extending therefrom.

For a better understanding of the invention and its operation, turning now to the drawings, FIG. 1 illustrates preferred accessory connector 10 in exploded view from vehicle fusebox 12 as is commonly used in automobiles and other vehicles. Accessory connector 10 includes a pair of connector blades 11, 11' extending from plastic housing 13. As shown in FIG. 1A, accessory connector 10 defines a pair of fuse blade receptacles 14, 14' in the top of housing 13 for receiving fuse blades 15, 15'. As would be understood, fuse 16 consists of a conventional vehicle fuse. However, as shown in the exploded view of FIG. 1, accessory connector 10 is removed from fusebox 12 and fuse 16 will be piggy-backed thereon. Conductor 17, the preferred form, as seen comprises a standard covered electrical wire for providing electrical power to a stereo, radio, CD or other vehicle accessory as desired.

Fusebox 12 as shown in FIG. 1 provides a pair of openings along top 23 for receiving respectively, accessory connector blades 11, 11'. As would be understood other configurations of fuses and fuseboxes may require additional openings. Also, while accessory connector 10 illustrates only one conductor 17 attached, other accessory connectors may be formed with additional conductors attached as required.

Figure 5:
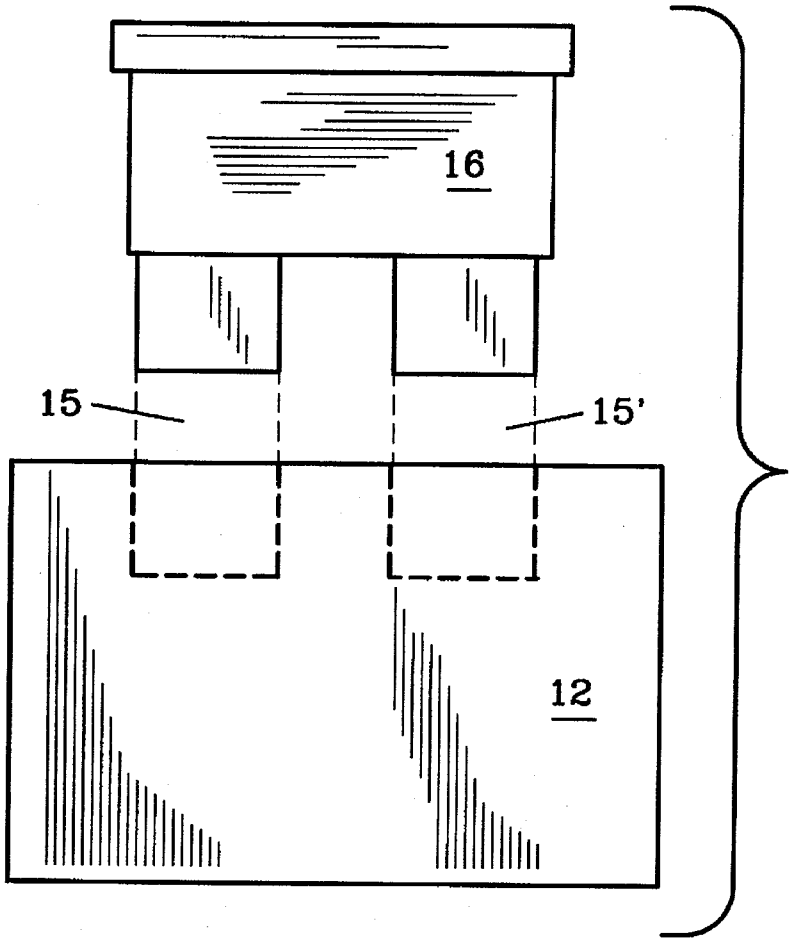
FIG. 5 pictures a schematic prior art fuse and fuse box for a vehicle.

In FIGS. 2 and 4 accessory connector blade 11 is illustrated joined to conductor 17. Connector blades 11 and 11' are formed of metal such as copper and are configured to receive fuse blades 15 and 15' as seen in FIG. 1, in its upper portion (saddle 18 in FIG. 3). As further seen in FIG. 4, accessory connector blade 11 includes a side tab 19 which receives wire 20 of conductor 17. FIG. 5 shows the prior art fuse box with fuse exploded therefrom.

It will be appreciated by those skilled in the order that the accessory connector 10 as illustrated herein will provide many advantages to both the vehicle owner and accessory installer. For example, extensive rewiring will no longer be required and an accessory joined to conductor 17 will be protected with an in-line fuse (not shown) as needed. Also, the installation will take but a few minutes and will be relatively inexpensive.

The illustrations and examples provided herein are for explanatory purposes and are not intended to limit the scope of the appended claims which encompass the invention and equivalents thereof.

I claim:

1. A connector comprising: a housing, a first connector blade extending from said housing, said first connector blade comprising a side tab, said side tab being substantially coplanar with said first connector wire blade, an accessory conductor, said accessory conductor wire directly connected to said side tab and in electrical communication with said first connector blade, said accessory conductor wire extending from said housing, said housing defining a first fuse blade receptacle, said first fuse blade receptacle for providing electrical communication between said first connector blade and a fuse positioned in said first fuse blade receptacle.

2. The connector of claim 1 and including a second connector blade, said second connector blade extending from said housing.

3. The connector of claim 2 wherein said housing defines a second fuse blade receptacle, said second fuse blade receptacle providing electrical communication between said second connector blade and a fuse positioned in said second fuse blade receptacle.

4. The connector of claim 1 wherein said first connector blade is formed from metal.

5. The connector of claim 1 wherein said accessory conductor wire comprises an insulated wire.

6. The connector of claim 1 wherein said housing is formed of plastic.

7. The connector of claim 6 wherein said plastic is non-conducting.

8. A connector for insertion in a vehicle fuse box to provide electrical power to an accessory, said connector comprising: a housing, a pair of connector blades for insertion into said fuse box, said connector blades extending from said housing, a first one of said connector blades comprising a side tab, said side tab being substantially coplanar with said first connector blade, said housing defining a pair of fuse blade receptacles, each of said pair of fuse blade receptacles for providing electrical communication between said connector blade and one of a pair of fuse blades inserted into said receptacle, and an accessory conductor wire, said accessory conductor wire directly connected to said side tab and in electrical communication with said first connector blade.

9. The connector of claim 8 wherein said housing is formed from plastic.

10. The connector of claim 8 wherein said accessory conductor comprises a covered wire.

11. A connector for insertion into a vehicle fuse box, comprising:

(a) a plastic housing, said housing defining a pair of fuse blade receptacles for reception of an automotive fuse having a pair of fuse blades;

(b) a first and a second connector blade extending from said housing, said connector blades for insertion into the vehicle fuse box, said first connector blade defining a first fuse blade receptacle, said first and said second connector blades each being formed of an electrically conductive material, said first and said second connectors each defining a saddle, said saddle for receiving the fuse blades of the automotive fuse, said second connector blade defining a second fuse receptacle, said first and said second fuse blade receptacles for receiving an automotive fuse, a side tab, said side tab attached to and coplanar with said first connector blade; and (c) an accessory conductor wire directly connected to said side tab, said accessory conductor wire extending from said housing.

* * * * *